US011959375B2

(12) United States Patent
Ji et al.

(10) Patent No.: US 11,959,375 B2
(45) Date of Patent: Apr. 16, 2024

(54) METHOD FOR EVALUATING DOWNHOLE WORKING CONDITION OF A PDC BIT

(71) Applicant: CNPC Engineering Technology R&D Company Limited, Beijing (CN)

(72) Inventors: Guodong Ji, Beijing (CN); Haige Wang, Beijing (CN); Meng Cui, Beijing (CN); Zhao Meng, Beijing (CN); Qiang Wu, Beijing (CN); Li Liu, Beijing (CN); Jiawei Zhang, Beijing (CN); Changchang Chen, Beijing (CN); Liu Cui, Beijing (CN); Jing Yu, Beijing (CN)

(73) Assignee: CNPC Engineering Technology R&D Company Limited, Beijing (CN)

( * ) Notice: Subject to any disclaimer, the term of this patent is extended or adjusted under 35 U.S.C. 154(b) by 531 days.

(21) Appl. No.: 17/202,584

(22) Filed: Mar. 16, 2021

(65) Prior Publication Data

US 2021/0301643 A1 Sep. 30, 2021

(30) Foreign Application Priority Data

Mar. 27, 2020 (CN) ..... 202010227449.7

(51) Int. Cl.
*E21B 45/00* (2006.01)
*E21B 10/567* (2006.01)
(Continued)

(52) U.S. Cl.
CPC ..... *E21B 45/00* (2013.01); *E21B 10/567* (2013.01); *E21B 12/02* (2013.01); *E21B 49/003* (2013.01); *E21B 2200/20* (2020.05)

(58) Field of Classification Search
CPC ..... E21B 45/00; E21B 10/567; E21B 10/54; E21B 10/46; E21B 12/02; E21B 49/003; E21B 2200/20; E21B 44/04; E21B 47/00
See application file for complete search history.

(56) References Cited

U.S. PATENT DOCUMENTS

2005/0096847 A1* 5/2005 Huang ..... E21B 44/00 702/9
2006/0272859 A1* 12/2006 Pastusek ..... E21B 25/16 175/40

(Continued)

FOREIGN PATENT DOCUMENTS

CN 103091082 A 5/2013

OTHER PUBLICATIONS

Zhan, "The Experimental Study of PDC Bits Mechanical Model", A Thesis Submitted for the Degree of Master, College of Petroleum Engineering, China University of Petroleum (EastChina), Oct. 19, 2020, 10 pages.

*Primary Examiner* — Catherine T. Rastovski
*Assistant Examiner* — Lal C Mang
(74) *Attorney, Agent, or Firm* — Dorsey & Whitney LLP

(57) ABSTRACT

A method for evaluating a downhole working condition of a PDC bit includes: performing an indoor test, including performing a drilling test in different full-sized cores by using the PDC bit with different degrees of abrasion and balling under condition of given WOB and rotational speed, to acquire change characteristics of a WOB, a rotational speed, a torque, a ROP and a bit vibration of the PDC bit in different time domains; improving and perfecting an existing prediction model and evaluation method for the downhole working condition through data obtained by the test to obtain the method; reading parameters of the WOB, the rotational speed, the torque and the ROP in real time during drilling; determining the downhole working condition of the PDC bit by using the method in the improving and perfecting.

6 Claims, 2 Drawing Sheets

(51) Int. Cl.
*E21B 12/02* (2006.01)
*E21B 49/00* (2006.01)

(56) References Cited

U.S. PATENT DOCUMENTS

| | | | | |
|---|---|---|---|---|
| 2012/0222852 | A1* | 9/2012 | Pelletier | 166/53 |
| 2014/0116776 | A1* | 5/2014 | Marx | E21B 12/02 706/11 |
| 2014/0318866 | A1* | 10/2014 | Lewis | 175/40 |
| 2020/0386659 | A1* | 12/2020 | Li | G01N 3/10 |

* cited by examiner

METHOD FOR EVALUATING DOWNHOLE WORKING CONDITION OF A PDC BIT

CROSS REFERENCE TO RELATED APPLICATION

This application claims the priority of Chinese Patent Application No. 202010227449.7, entitled "METHOD FOR EVALUATING DOWNHOLE WORKING CONDITION OF A PDC BIT" filed with the Chinese Patent Office on Mar. 27, 2020, which is incorporated herein by reference in its entirety.

TECHNICAL FIELD

The present disclosure relates to the field of oil and gas exploration, and in particular, to a method for evaluating downhole working condition of a PDC bit (Polycrystalline Diamond Compact bit).

BACKGROUND ART

In rotary drilling and downhole power drilling, the bit is a primary tool to crush rock. The PDC bit is one of the most commonly bit types used in drilling operations at present. Typically, PDC bit has bit teeth with high hardness and good abrasion resistance, which has advantages of high rate of penetration (ROP) and stable performance in shallow stratum and shows great economic value in oil and gas exploration.

Currently, it is mainly based on working time to analyze and judge the downhole condition of most bits during drilling. In drilling operation, the downhole environment becomes more complicated and tripping time becomes longer as depth increases. Downhole bit working condition such as severe abrasion or balling would cause more drilling time and cost, even severe downhole accidents. Therefore, it is of great significance for reducing drilling time and cost saving to identify the downhole working condition of the PDC bit during drilling.

SUMMARY

An object of some embodiments is to provide a method for evaluating a downhole working condition of a PDC bit, so as to solve the problem existing in the prior art and determine the downhole working condition of the PDC bit by reading parameters such as weight on bit (WOB) and rotational speed during drilling.

In order to achieve the above object, the present disclosure provides the following solutions.

It is provided a method for evaluating the downhole working condition of the PDC bit by the present disclosure, which includes the following steps:

performing an indoor test, including performing a drilling test in different full-sized cores by using the PDC bit with different degrees of abrasion and balling under conditions of given WOB and rotational speed, to acquire change characteristics of a WOB, a rotational speed, a torque, a ROP and a vibration severity of the PDC bit in different time domains when the PDC bit drills in different cores under different drilling parameters;

improving and perfecting an existing prediction model and evaluation method for the downhole working condition through data obtained by the test to obtain a method for evaluating the downhole working condition of the PDC bit;

reading parameters of the WOB, the rotational speed, the torque and the ROP in real time during drilling;

determining the downhole working condition of the PDC bit by using the method obtained in the improving and perfecting.

In some embodiments, a test device and test instrument required in the performing the indoor test may include an acceleration acquisition system fixed on a drill pipe nipple; a first end of a WOB-torque-displacement acquisition system are mounted beneath the drill pipe nipple, and a second end of the WOB-torque-displacement acquisition system is connected to the PDC bit. The PDC bit is connected with a hydraulic system, and the core is provided below the PDC bit and fixed on a rotary table.

In some embodiments, the WOB-torque-displacement acquisition system may include a dynamic strain gauge, a bridge box and a first data acquisition system; the acceleration acquisition system comprises a wireless acceleration transducer, a wireless gateway, and a second data acquisition system.

In some embodiments, in the performing the indoor test, the PDC bit and the drill pipe nipple are in a stationary state, and the rotary table and the core are rotated at an invariant rotational speed, when the test is performed.

In some embodiments, in the performing the indoor test, the WOB of the PDC bit for the test is adjusted at intervals of 5 KN.

In some embodiments, in performing the indoor test, the rotational speed of the test is adjusted at interval of 15 revolutions per minute.

In some embodiments, the core is limestone, hard sandstone or soft sandstone.

In some embodiments, a manner for processing data of the WOB, the torque and a displacement obtained in the performing the indoor test is illustrated as follows: intercepting a WOB data, a torque data and a displacement data in a time domain during which the WOB is stable, and obtaining average values of all intercepted data as the WOB data, the torque data and the displacement data of the test. A manner for processing acceleration data is illustrated as follows: obtaining absolute values of tangential acceleration data and radial acceleration data, and obtaining a first root mean square value and a first maximum value based on the absolute values of the tangential acceleration data and a second root mean square value and a second maximum value based on the absolute values of the radial acceleration data, obtaining absolute values of axial acceleration data after adjusting a baseline to 0, adding 1 to the absolute values of the axial acceleration data, and obtaining a third root mean square value and a third maximum value based on the absolute values added of the axial acceleration data. An existing evaluation method for the downhole working condition are improved and perfecting through data obtained by the test, to obtain a method for evaluating the downhole working condition of the PDC bit. During practical drilling, parameters such as WOB, torque and ROP are recorded to determine the downhole working condition of the bit in real time by the evaluation method.

The present disclosure achieves the following beneficial technical effects compared with the prior art:

The vibration of the bit and lithology are added to the parameters for evaluating the downhole working condition of the bit. Thus, during drilling, using the drilling method facilitates to improve the determination of the downhole working condition of the PDC bit and a drilling efficiency during drilling, which helps to avoid the problem such as long drilling cycle and high operation cost.

BRIEF DESCRIPTION OF THE DRAWINGS

In order to more clearly illustrate the embodiments of the disclosure or the technical solutions in the prior art, the drawings required in the embodiments will be briefly described below, it is apparent that the drawings in the following description are only some embodiments of the disclosure, for those skilled in the art, other drawings can be obtained according to these drawings without inventive labors.

Figure 1:
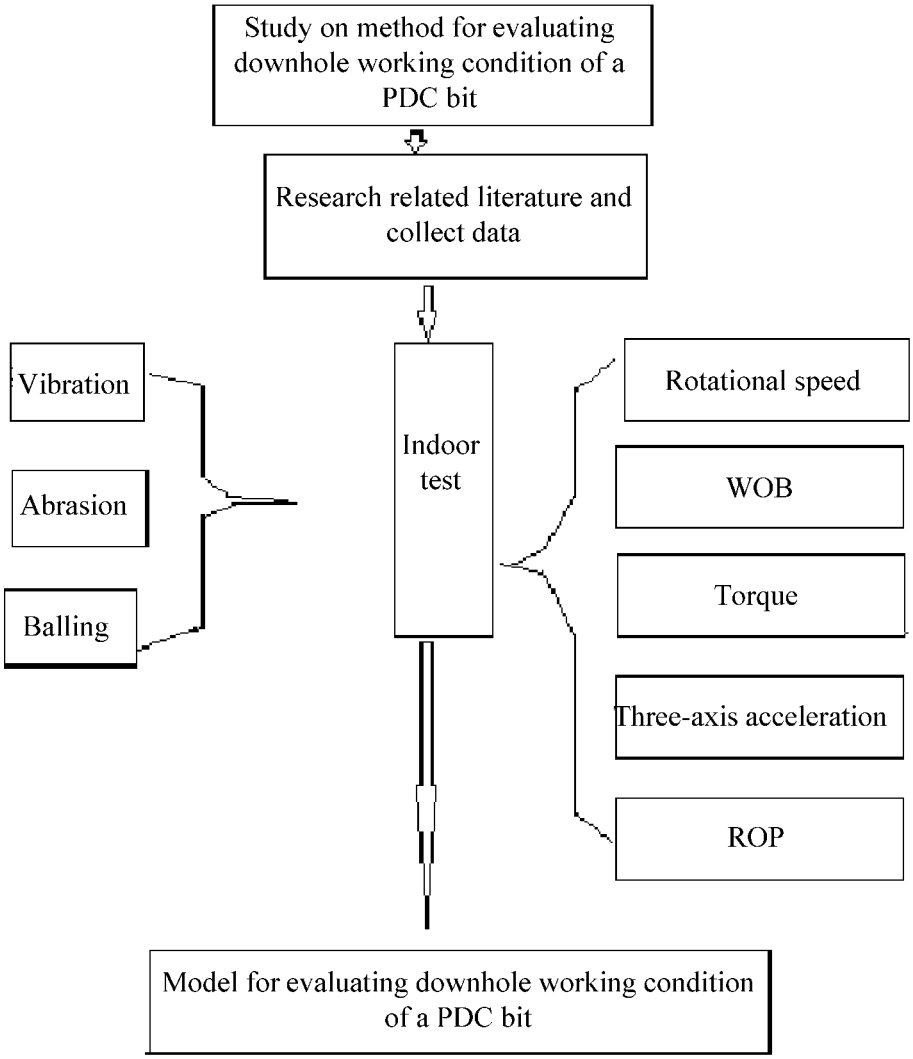
FIG. 1 is a schematic flowchart of a method for evaluating a working condition of a PDC bit according to the present disclosure.

List of reference numerals: 1 drill pipe nipple, 2 first acceleration transducer, 3 second acceleration transducer, 4 WOB-torque-displacement transducer, 5 drill bit, 6 core, and 7 rotary table.

DETAILED DESCRIPTION OF THE EMBODIMENTS

The technical solutions in the embodiments of the present disclosure will be clearly and completely described below combining with the accompanying drawings in the embodiments of the present disclosure, and it is apparent that the embodiments described are only a part of the embodiments of the present disclosure, and not all of them. All other embodiments, which are obtained by a person skilled in the art based on the embodiments of the present disclosure without inventive labors, shall fall within the protection scope of the present disclosure.

An object of some embodiments is to provide a method for evaluating a downhole working condition of a PDC bit so as to solve the problem existing in the prior art, and to determine the downhole working condition of the PDC bit by reading parameters such as WOB and rotational speed during drilling.

In order to make the above objects, features and advantages of the present disclosure more apparent, the present disclosure is further and in detail described combining with the accompanying drawings and specific embodiments thereof.

It is provided a method for evaluating the downhole working condition of the PDC bit by the present disclosure. As shown in FIG. 1, a method for evaluating the downhole working condition of the PDC bit includes the following steps. In step S1, an indoor test is performed. In step S2, a drilling test is performed on different full-sized cores by using the PDC bit with different degrees of abrasion and balling under conditions of given WOB and rotational speed, to acquire change characteristics of the WOB, rotational speed, torque, ROP and vibration severity of the PDC bit in different time domains when drilling in different cores under different drilling parameters. In step S3, an existing prediction model and an evaluation method for the downhole working condition are improved and perfecting through data obtained by the test, to obtain a method for evaluating the downhole working condition of the PDC bit. In step S4, parameters such as the WOB, the rotational speed, the torque and the ROP are read in real time during drilling. In step S5, the downhole working condition of the PDC bit is determined by using the method obtained in the step S4.

Figure 2:
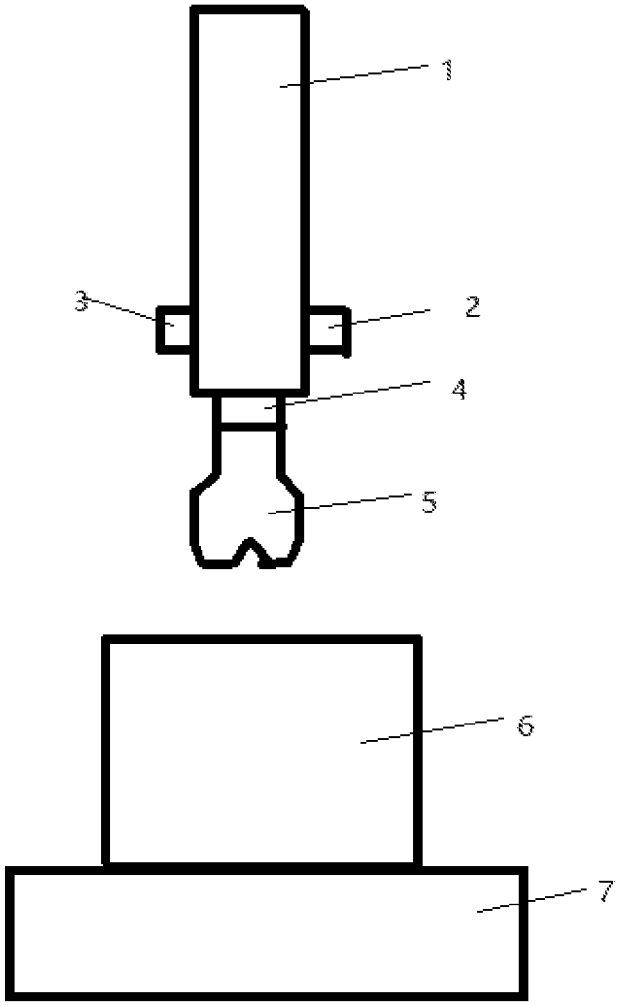
FIG. 2 is a schematic diagram of a test device for evaluating the working condition of the PDC bit according to the present disclosure.

FIG. 2 is a schematic diagram of an indoor test device including an acceleration acquisition system, the acceleration acquisition system may include a first acceleration transducer 2 and a second acceleration transducer 3 symmetrically fixed on a drill pipe nipple 1. The acceleration acquisition system further includes a WOB-torque-displacement acquisition system, which includes a WOB-torque-displacement transducer 4. The WOB-torque-displacement transducer 4 are connected to the drill pipe nipple 1 therebelow, and then coupled to the bit 5. The core 6 is fixed on the rotary table 7. The rotary table 7 drives the core 6 to rotate in counter-clockwise. A hydraulic system is configured for loading and adjusting a WOB loaded on the bit 5. The WOB-torque-displacement transducer 4 may collect data of parameters such as WOB, torque and displacement. The first acceleration transducer 2, the second acceleration transducer 3 may collect three-axis acceleration data via a wireless gateway. In the drilling experiment, signals such as WOB, torque, drilling time and drilling footage measured by different types of transducers are input into a computer acquisition system. A displacement of the bit is measured by a high-precision strain-gauge displacement transducer, and the signals from the displacement transducer are converted by the dynamic strain gauge to achieve the conversion between a voltage and an amount of the footage. The acceleration data is collected by the wireless acceleration transducer, and transmitted to the computer acquisition system through the wireless gateway.

A manner for processing data such as the WOB, the torque and a displacement obtained in the present disclosure is specified as follows: intercepting WOB data, torque data and displacement data in a time domain when the WOB is stable, and obtaining average values of all intercepted data as the WOB data, the torque data and the displacement data of the test. A manner for processing acceleration data is specified as follows: obtaining absolute values of tangential acceleration data and radial acceleration data, and a first root mean square value and a first maximum value based on the absolute values of the tangential acceleration data and a second root mean square value and a second maximum value based on the absolute values of the radial acceleration data, obtaining absolute values of axial acceleration data after adjusting a baseline to 0, adding 1 to the absolute values of the axial acceleration data, and obtaining a third root mean square value and a third maximum value based on the absolute values added of the axial acceleration data. An existing evaluation method for the downhole working condition are improved and perfecting through data obtained by the test, to obtain a method for evaluating the downhole working condition of the PDC bit. During practical drilling, parameters such as WOB, torque and ROP are recorded to determine the downhole working condition of the bit in real time by the evaluation method.

The present disclosure has at least the following advantages with respect to the prior art:

1) The drilling efficiency is high. When a PDC bit is used, it is required to frequently check working condition of the bit, so as to repair or replace the bit in time. Some important drilling parameters (also known as working condition) decide the performance of the PDC bit. For example, tripping out too early may cause more drilling time and cost, and tripping out too late may cause an accident. Determining the downhole working condition of the PDC bit is important for reduce the drilling time.
2) The drilling cost is low. By timely obtaining the downhole working condition of the PDC bit, the bit can be timely tripped, run and replaced, and thus the occurrence probability of drilling accident is reduced.

Also, the drilling cost and the non-productive time caused by bit problem are reduced as the ROP is improved.

The principle and the embodiments of the present disclosure are explained by using specific examples in the present disclosure, and the above description of the embodiments is only used to help understand the method and the core idea of the present disclosure. Moreover, it is apparent for a person skilled in the art to modify the specific embodiments and the application range according to the idea of the present disclosure. In conclusion, the contents of the description should not be construed as limitations on the disclosure.

What is claimed is:

1. A method for evaluating downhole working condition of a polycrystalline diamond compact (PDC) bit, the method comprising:

performing an indoor test, comprising performing a drilling test in different full-sized cores by using the PDC bit with different degrees of abrasion and balling under conditions of given weight on bit (WOB) and rotational speed to acquire change characteristics of a WOB, a rotational speed, a torque, a rate of penetration (ROP), and a vibration severity of the PDC bit in different time domains when the PDC bit drills in different cores under different drilling parameters;

improving and perfecting an existing prediction model and evaluation method for the downhole working condition through data obtained by the test to obtain a method for evaluating the downhole working condition of the PDC bit;

reading parameters of the WOB, the rotational speed, the torque and the ROP in real time during drilling; and determining the downhole working condition of the PDC bit by using the method obtained in the improving and perfecting;

wherein, a test device and a test instrument required in the performing the indoor test comprise an acceleration acquisition system fixed on a drill pipe nipple; a first end of a WOB-torque-displacement acquisition system are mounted beneath the drill pipe nipple, and a second end of the WOB-torque-displacement acquisition system is connected to the PDC bit, the PDC bit is connected with a hydraulic system, and the core is provided below the PDC bit and fixed on a rotary table; and wherein a manner for processing data of the WOB, the torque and a displacement obtained in the performing the indoor test is as follows: intercepting a WOB data, a torque data and a displacement data in a time domain during which the WOB is stable, and obtaining average values of all intercepted data as the WOB data, the torque data and the displacement data of the test; a manner for processing acceleration data is as follows: obtaining absolute values of tangential acceleration data and radial acceleration data, and obtaining a first root mean squares value and a first maximum value based on the absolute values of the tangential acceleration data and a second root mean squares value and a second maximum value based on the absolute values of the radial acceleration data, obtaining absolute values of axial acceleration data after adjusting a baseline to 0, adding 1 to the absolute values of the axial acceleration data, and obtaining a third root mean square value and a third maximum value based on the absolute values added of the axial acceleration data.

2. The method of claim 1, wherein the WOB-torque-displacement acquisition system comprises a dynamic strain gauge, a bridge box and a first data acquisition system; the acceleration acquisition system comprises a wireless acceleration transducer, a wireless gateway, and a second data acquisition system.

3. The method of claim 1, wherein in the performing the indoor test, the PDC bit and the drill pipe nipple are in a stationary state, and the rotary table and the core are rotated at an invariant rotational speed, when the indoor test is performed.

4. The method of claim 3, wherein in the performing the indoor test, the WOB of the PDC bit for the test is adjusted at intervals of 5 KN.

5. The method of claim 3, wherein in the performing the indoor test, the rotational speed for the test is adjusted at interval of 15 revolutions per minute.

6. The method of claim 1, wherein the core includes limestone, hard sandstone, or soft sandstone.

* * * * *